US005443121A

United States Patent [19]

Saucier

[11] Patent Number: 5,443,121

[45] Date of Patent: Aug. 22, 1995

[54] GRAVEL-PACKING APPARATUS & METHOD

[76] Inventor: Randolph J. Saucier, 8088 Winners Cir., Mandeville, La. 70448

[21] Appl. No.: 264,724

[22] Filed: Jun. 23, 1994

[51] Int. Cl.[6] ..... E21B 43/04; E21B 43/08

[52] U.S. Cl. ..... 166/278; 166/51; 166/205

[58] Field of Search ..... 166/51, 278, 205, 74, 166/296, 236

[56] References Cited

U.S. PATENT DOCUMENTS

| | | | |
|---|---|---|---|
| Re. 34,451 | 11/1993 | Donovan et al. . | |
| 3,726,343 | 4/1973 | Davis, Jr. | 166/278 |
| 4,270,608 | 6/1981 | Hendrickson et al. | 166/278 |
| 4,295,524 | 10/1981 | Baker et al. | 166/278 |
| 4,635,725 | 1/1987 | Burroughs | 166/278 |
| 4,856,591 | 8/1989 | Donovan et al. | 166/278 |
| 4,880,059 | 11/1989 | Brandell et al. . | |
| 4,991,654 | 2/1991 | Brandell et al. . | |
| 5,016,716 | 5/1991 | Donovan et al. . | |
| 5,067,568 | 11/1991 | Yates, Jr. et al. . | |
| 5,076,355 | 12/1991 | Donovan et al. . | |
| 5,261,486 | 11/1993 | Cornette et al. | 166/51 |
| 5,330,003 | 7/1994 | Bullick | 166/278 |

*Primary Examiner*—Ramon S. Britts
*Assistant Examiner*—Frank S. Tsay
*Attorney, Agent, or Firm*—Rosenblatt & Redano

[57] ABSTRACT

A gravel-packing apparatus and method is disclosed which involves a movable sleeve over a screen. The screen is fixed to a packer downhole while the sleeve is operated from the surface. As the sleeve is lifted to expose more of the screen, the granular material deposits along the outside of the screen and through the exposed perforations, starting from the packer and working its way up. The annulus is sealed by multiple cup seals or other suitable seals for the environment so that the slurry pressure applied from the surface is directed to deposition of the granular material adjacent the exposed perforations. As more granular material is deposited, the crew at the surface may further pull the sleeve up or the developed pressure downhole itself can force the sleeve further up, exposing additional perforations and continuing the deposition process of the granular material. At the conclusion of the operation, the outer sleeve is removed and the screen is left in place for subsequent production from the gravel-packed perforations. Later, if desired, the gravel screen may be retrieved from the wellbore. The shifting sleeve may be a solid member with external seals against the casing to temporarily obstruct some of the perforations. In the alternative, the sliding sleeve may be an inflatable member with built-in seals.

20 Claims, 3 Drawing Sheets

GRAVEL-PACKING APPARATUS & METHOD

FIELD OF THE INVENTION

The field of the invention relates to an apparatus and method for improved gravel packing for downhole applications.

BACKGROUND OF THE INVENTION

Gravel packing is a term known in the oil and gas business which involves, in one class of applications, the placement of a granular material outside of casing perforations to improve the performance of the well by causing the formation material to be constrained, thus allowing formation fluids better access to the tubing string and ultimately to the surface. In the past this has been accomplished by placing a screen in the appropriate location and pumping down, in slurry form, the fluid bearing the granular material so that it could deposit. Problems have ensued with this type of procedure because with the material being pumped from above the top of the perforated interval, a potential existed for bridges and blocks to form uphole which would in turn prevent adequate and thorough high-density packing and distribution of the granular material out, across and around the entire perforated interval and length of the screen. Incomplete packing of the casing-screen annulus, perforations, and areas outside of the perforated casing are well-known causes of sand control failure and/or poor gravel-packed well productivity. Such incomplete packing is the result of efforts to pack a lengthy interval where significant differences in perforation injectivity prevent packing of all perforations.

The apparatus and method of the present invention address this potential faulty distribution and packing problem by providing a technique to pack within and outside of the perforated interval and outside of the screen systematically in smaller segments from the bottom up. With the technique of the present invention, the risk of bridging or blocking at the upper end, precluding adequate distribution at the lower end, is greatly reduced if not eliminated. Additionally, by packing smaller segments systematically, the problem of incomplete perforation packing is reduced if not eliminated. Thus, a more efficient and effective gravel-pack job can be accomplished with the apparatus.

Accordingly, it is an object of the present invention to facilitate thorough distribution of the granular material around a screen and within and outside of the perforated interval by virtue of deposition of the granular material around the screen and perforated interval from the bottom up. It is also an object of the present invention to improve performance of wells by providing a more efficient and productive gravel pack for the well operator.

SUMMARY OF THE INVENTION

A gravel-packing apparatus and method is disclosed which involves a movable sleeve over a screen. The screen is fixed to a packer downhole while the sleeve is operated from the surface. As the sleeve is lifted to expose more of the screen, the granular material deposits along the outside of the screen and through the exposed perforations, starting from the packer and working its way up. The annulus is sealed by multiple cup seals or other suitable seals for the environment so that the slurry pressure applied from the surface is directed to deposition of the granular material adjacent the exposed perforations. As more granular material is deposited, the crew at the surface may further pull the sleeve up or the developed pressure downhole itself can force the sleeve further up, exposing additional perforations and continuing the deposition process of the granular material. At the conclusion of the operation, the outer sleeve is removed and the screen is left in place for subsequent production from the gravel-packed perforations. Later, if desired, the gravel screen may be retrieved from the wellbore. The shifting sleeve may be a solid member with external seals against the casing to temporarily obstruct some of the perforations. In the alternative, the sliding sleeve may be an inflatable member with built-in seals.

DETAILED DESCRIPTION OF THE PREFERRED EMBODIMENT

Figure 1:
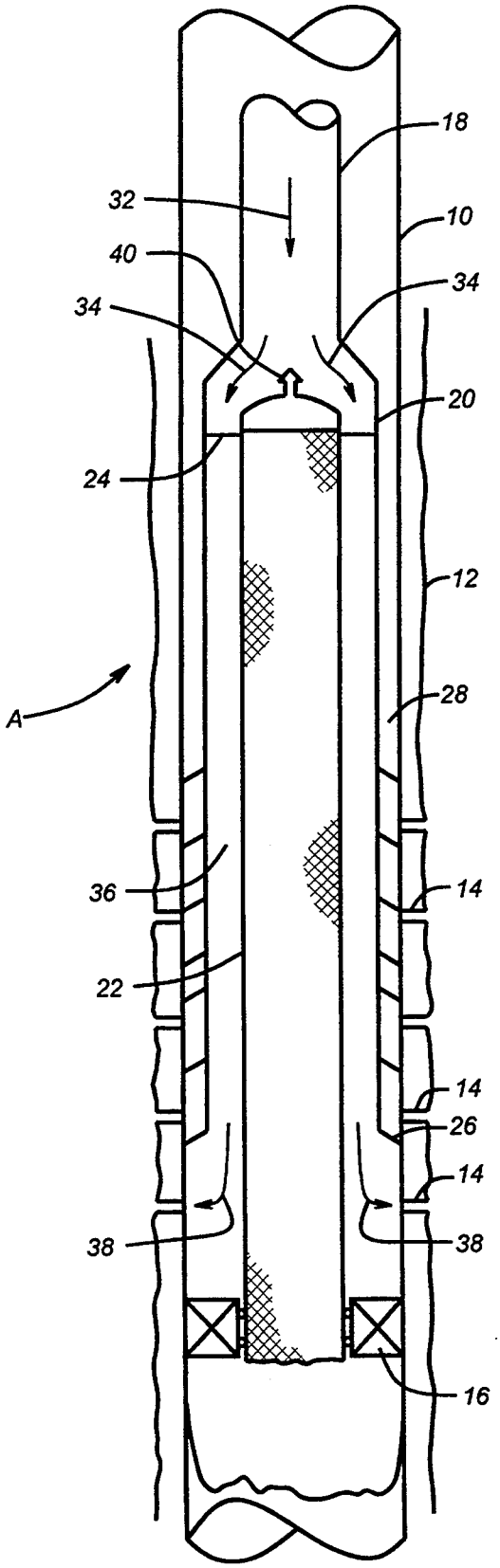
FIG. 1 illustrates a preferred embodiment of the apparatus and method of the present invention in a sectional elevational partly schematic view.

The apparatus A is illustrated in FIG. 1. A casing 10 has been cemented using cement 12 and perforated to make the perforations 14. In the preferred embodiment, the perforations 14 in the casing 10 may be made with a burr-free perforator, or in the alternative the perforations 14 are scraped internally at the casing 10 to remove burrs and other rough or jagged edges.

A packer 16 is set in the casing 10 in the usual manner, well-known in the art. The tubing string, represented schematically as 18, is lowered into casing 10 to the area adjacent the perforations 14. During run-in, a sleeve 20 is disposed at the lower end of string 18. Extending out below sleeve 20 is screen 22. A connection mechanism 24 of a type well-known in the art is provided at the base of screen 22 to allow selective engagement with packer 16. Once the screen 22 is anchored to packer 16, which is already engaging the casing 10, the method of the present invention can be initiated.

Mounted on the outside of sleeve 20 is an aggregation of cup-shaped seals 26 sufficient to span the perforated interval. While an aggregation of cup seals 26 in series is preferred over other seals, other seals may be incorporated with sleeve 20 without departing from the spirit of the invention. Additionally, a single seal between screen 22 and casing 10 can be incorporated without departing from the spirit of the invention. A single seal may be a discrete seal of relatively short height compared to its radius or can be one continuous flexible member having a height substantially longer than its radius. As shown in FIG. 1, a stack of seals 26 seals the annular space 28 and isolates the upper perforations 14 from those disposed below the lowermost seal 26 during the gravel-packing procedure.

Screen 22 can be temporarily supported by sleeve 20 or tubing string 18 by the connection mechanism 24 when it is anchored to packer 16. At that time an upward pull or a combination of movements can be applied to the tubing string 18 to obtain release of sleeve 20 from screen 22. One type of attachment can be a shear pin or pins 30 (see FIG. 6). A mechanical assembly (e.g., J-slot) can also be employed for the temporary fixation of the sleeve 20 to the screen 22 during the run-in position, which will allow release of the sleeve from the screen by manipulation.

The gravel-packing procedure of the present invention is initiated by pumping the granular material in a slurry down the tubing string 18, as indicated by arrow 32. The slurry goes around the screen as indicated by arrows 34. In the initial position shown in FIG. 1, the granular material travels downwardly in annular space 36 until it gets to the vicinity of the lowermost perforations 14 which are not covered up by seal or seals 26. The result is a deposition of the granular material above packer 16 through the exposed perforations, and outside of screen 22, starting from the packer 16 and moving on upwardly. As the space between the screen 22 and the exposed perforations 14 begins to fill with granular material, the operator at the surface can displace the sleeve 20 upwardly to expose additional perforations 14. Alternatively or in combination, the resulting pressure build-up above the packer 16 from deposition of the granular material, represented by arrows 38, provides a net unbalanced upward force on sleeve 20 and the tubing string 18 which could be of sufficient magnitude to assist sleeve 20 in moving upwardly when allowed to from the surface. As sleeve 20 continues its upward movement, eventually all the perforations in a given zone are exposed, starting from the lowermost and on up the hole. By placing the granular material outside the screen 22 and outside the perforations systematically from packer 16 and then moving upwardly, the problems of deposition of granular material from the top down are eliminated. The concern in the prior methods was that the granular material deposited from above the uppermost perforations could bridge, settle, form nodes, or otherwise prevent an effective deposition of granular material along the entire operative length of screen 22 and throughout the entire perforated interval.

It is contemplated by the invention that a screen 22 of a type that is well-known in the art be used. Such a screen could have a plug with a fishing neck 40 to facilitate removal after gravel pack completion, thus providing access to a screen seal bore to receive production seals on the end of production tubing.

Figures 2, 3, 4, 5:
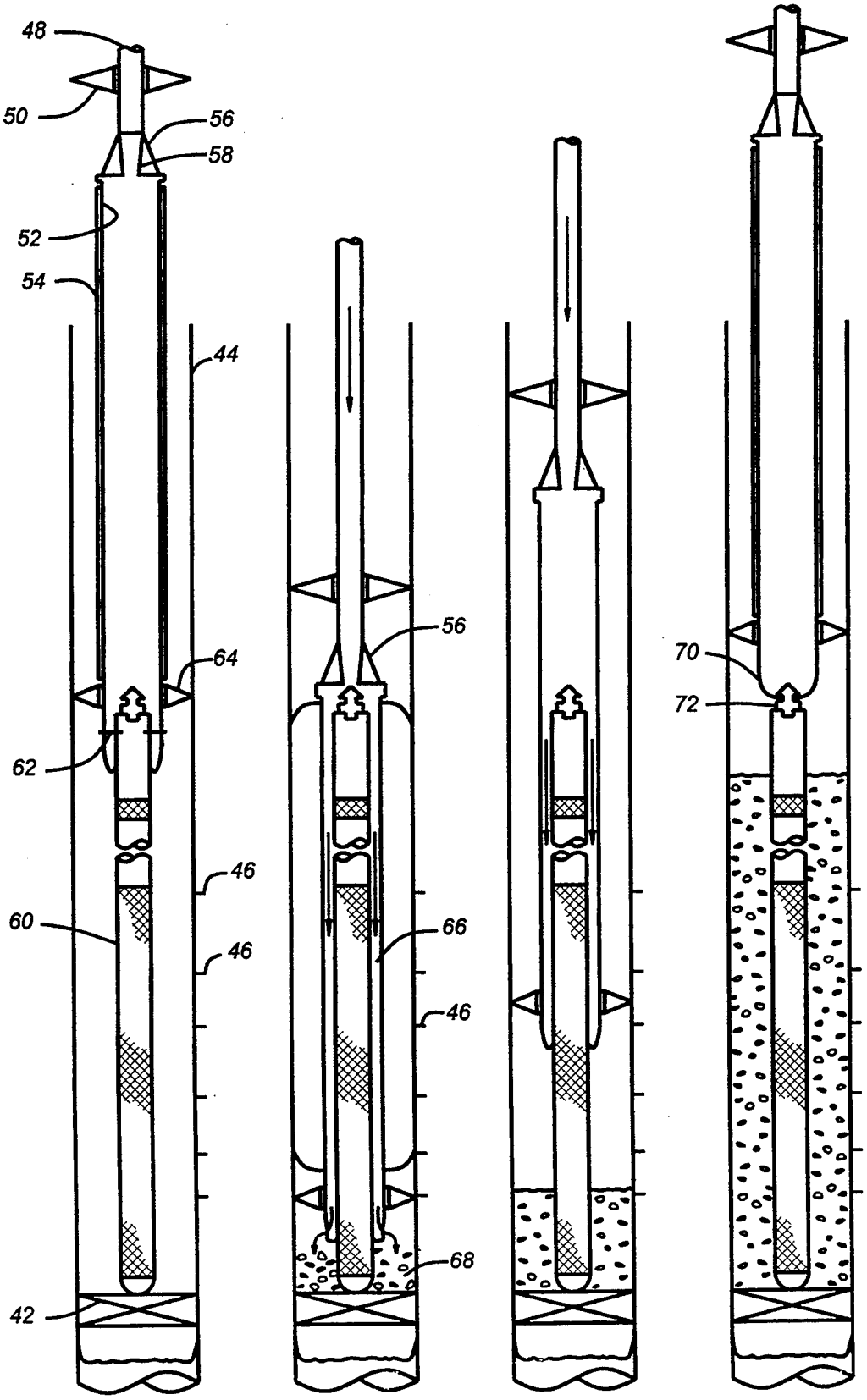
FIG. 2 is a sectional elevational schematic view of an alternative embodiment in the run-in position.
FIG. 3 is the view of FIG. 2, with the shifting sleeve inflated and granular material being delivered.
FIG. 4 is the view of FIG. 3, with the shifting sleeve in a shifted position after the onset of delivery of granular material.
FIG. 5 is the view of FIG. 3, with the packing operation concluded, showing the feature for retrieval of the screen protective plug.

FIGS. 2–5 illustrate an alternative embodiment of the present invention. In FIG. 2, the run-in position is illustrated. A packer 42 is already set in the wellbore 44. FIG. 2 illustrates that the wellbore 44 has already been perforated, by a schematic representation of the perforations 46. In the schematic representations of FIGS. 2–5, the reference to the wellbore 44 is also intended to include the presence of a cemented casing. However, the presence of a cemented casing in the vicinity of the perforations 46 is not mandatory for the operation of the apparatus A and method of the present invention.

As shown in FIG. 2, a tubing string 48, which could optionally include centralizers 50, supports a sleeve 52. Mounted outside sleeve 52 is a flexible inflatable member 54. Inflatable member 54 may be made of materials suitable to withstand the pressures and temperatures applied during use and of an appropriate wall thickness so that it can withstand sufficient pressures to remain in an inflated condition during pumping, as shown in FIG. 3, so that selected perforations 46 can be isolated. The preferred mode of inflation of inflatable member 54 is illustrated in FIG. 2. A plurality of screened ports 56 allows tubing 48 pressure to enter the inflatable member 54. A constriction 58 in the tubing 48 above the ports 56 causes sufficient pressure during pumping on the tubing to inflate the inflatable member 54. Such pressure may be created by inner flow member sizing as well. Upon supplying pressure from the surface via string 48, the fluid enters the screened openings 56 and inflates the member 54. This condition persists as long as tubing 48 pressure is applied.

Referring now to FIG. 2 in the run-in position, a screen 60 is temporarily supported to sleeve 52 by preferably a shear pin or pins 62. The screen 60 is located on bottom or stabbed into the packer 42 and anchored in the conventional manner. Thereafter, a downward force is applied to string 48 which results in breaking of pin or pins 26 and relative movement between sleeve 52 and screen 60. This can be seen by comparing FIGS. 2 and 3. Centralizers 64 may be used with the inflatable member 54 to further assist the proper positioning of the inflatable member 54 once it is inflated, as shown in FIG. 3.

Upon breaking of shear pin or pins 62 and proper positioning of sleeve 52, tubing pressure is applied to screened openings 56 by pumping operations, which results in inflation of inflatable member 54. At this time, most of the perforations 46 are obstructed, as shown in FIG. 3. At this time, the granular material used for the gravel pack is pumped down tubing 48 into an annular space 66. The granular material or gravel 68 exits the annular space 66 above packer 42. At this point, the granular material 68 begins to exit the exposed perforations and pack outside the casing in a preferred manner and cover up the volume between screen 60 and exposed perforations 46. The procedure continues with upward shifting of sleeve 52, either by an upward force applied to the tubing 48 from the surface or by the developed pressure outside of screen 60 which creates an upward force on inflated inflatable member 54. Upward movement of the inflated member 54, maintaining continuous pumping, may be achieved in some cases. In the alternative, the inflatable member 54 can be allowed to become partially deflated while the repositioning occurs, whereupon the inflatable member 54 is again reinflated in a higher position where more of the perforations 46 are exposed. The process continues from the packer 42 on upwardly until all of the perforations 46 are sufficiently packed and covered with the granular material 68 and the spaces between the perforations 46 and screen 60 and within and outside of all perforations are well packed. The only remaining step at that point is to deflate the inflatable member 54 and retrieve the sleeve 52. The sleeve 52 in the preferred method will come with a fishing assembly, schematically represented as 70, which can selectively remove the protective plug from the screen top by way of a fishing neck 72 in screen 60. Removal of the protective plug exposes a seal bore within the top section of the screen assembly that can subsequently receive production seals when production tubing is run. It is unlatched from the packer 42 in the conventional manner.

Figure 6:
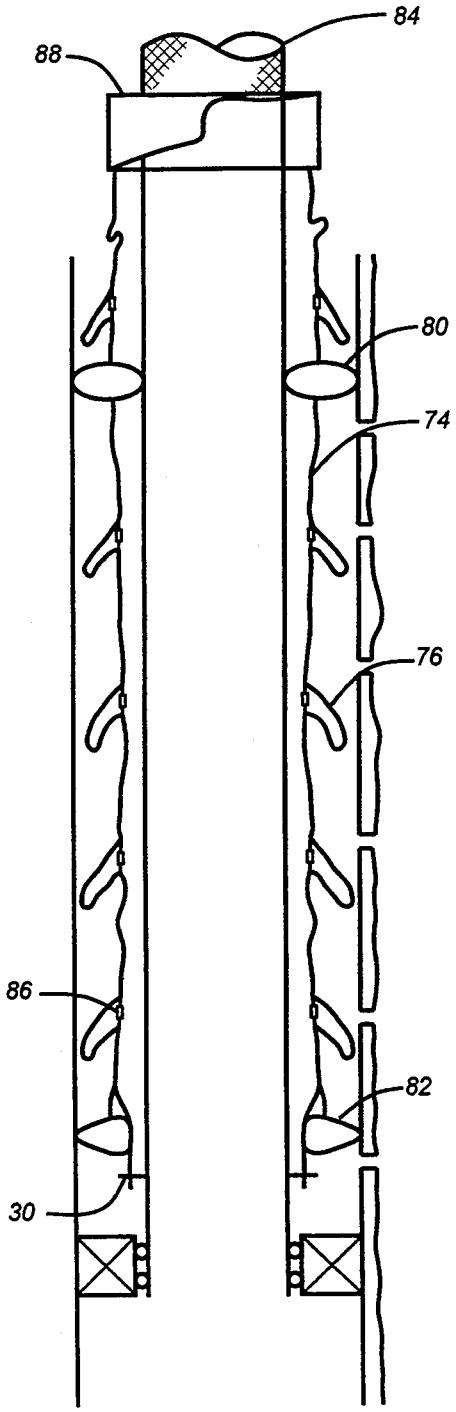
FIG. 6 is an alternative embodiment of the apparatus of FIG. 2, shown in the run-in position.
Figure 7:
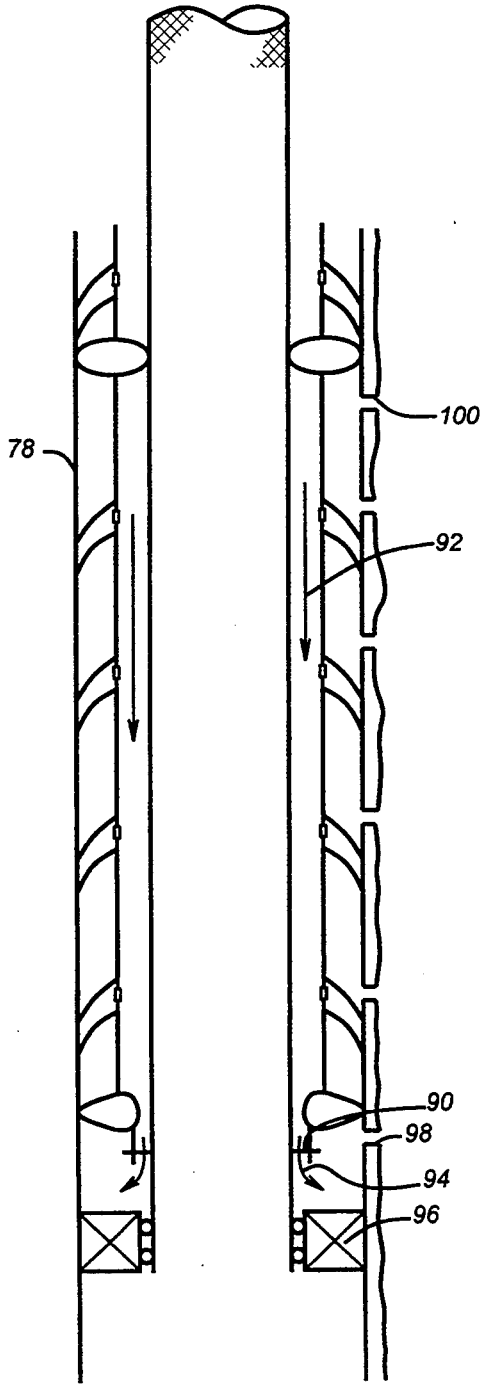
FIG. 7 is the view of FIG. 6, with the shifting sleeve in the inflated position and the granular material being placed outside the screen.

A third embodiment of the apparatus and method of the present invention is illustrated in FIGS. 6 and 7. FIGS. 6 and 7 show a different type of an inflatable member 74. This member has circumferentially extending seal elements 76. Seal elements 76 are downwardly extending in their collapsed state as shown in FIG. 6. When expanded as shown in FIG. 7, they extend outwardly into contact with the perforated casing 78. In the preferred embodiment, the seal elements 76 function like a plurality of cup seals. However, different configurations of a seal element or elements 76 may be used without departing from the spirit of the invention. Embodied in the inflatable member 74 are centralizers as illustrated by 80 and 82 spaced as required along the assembly. The inflatable member 74 is mounted over a screen 84. To facilitate inflation of each of the seal elements 76, a screened opening 86 is the entry point of fluids which enter the seal elements 76 after entering the main body of the inflatable member 74 adjacent its upper end 88. In the run-in position, the inflatable member 74 is temporarily secured to screen 84, typically by a shear pin or pins 30. A constricted opening or openings 90 create backpressure due to pumping within the inflatable assembly 74 for inflation of assemblies 74 and 76. Such pressure may also be created by inner flow member sizing as well. As shown by arrow 94, the pumped fluid with the granular material or gravel exits above the packer 96. The inner tubing or openings 90 are sized such that upon the establishment of sufficient flow with the granular material into upper end 88, a backpressure is maintained within inflatable member 74 such that it presents itself in the wellbore in the position shown in FIG. 7.

The procedure in using the method of the present invention involves first placing the screen 84 in the position shown in FIG. 6 and latching it to packer 96 in the conventional manner. Thereafter, the shear pins 30 are broken with an upward pull on the tubing which is at upper end 88. With the inflatable member 74 initially in the lowermost position as shown in FIG. 7, fluids are pumped into inflatable member 74, causing it to inflate due to the backpressure presented from openings 90. That same fluid is also the carrier fluid for the granular material, as represented by arrows 92 and 94. The granular material flows through the inflatable member 74 and is kept out of seal elements 76 because each one has a screened opening 86. Upon sufficient deposition of granular material through and adjacent to the lowermost perforations 98, which are shown exposed in FIG. 7, the inflatable member 74 is repositioned and the process continues. Repositioning may occur by upward surface control and/or by pressure created due to the packing process. Repositioning may occur with the elements inflated and pumping continuous in some cases. Alternatively, the flow can be temporarily interrupted, which results in partial deflation of inflatable member 74. Upon its subsequent repositioning, the flow is resumed, causing inflatable member 74 to reinflate in a higher position than that shown in FIG. 7. Sequentially, the granular material is placed outside of the entire perforated interval and screen 84 from the packer 96 on up to the topmost perforation 100, as shown in FIG. 7. It should be noted that the inflatable member 74 can be made of a sufficiently resilient material so that it can be shifted in an inflated position. This may require that the perforations 98 and 100 have been properly deburred. Due to the multiplicity of seals envisioned in the preferred embodiment, even a malfunction in one of the sealing elements 76 will not preclude the apparatus A from performing its intended function. As before, the deposition of the granular material, as indicated by arrow 94, could also act with the flowing fluid to raise the pressure below the inflatable member 74 but above the packer 96. This can result in an unbalanced force on the inflatable member 74, which can urge it in an upward position. If this occurs, it is not a problem since it is indicative that the area around the perforations already exposed is sufficiently packed. As previously stated, there is sufficient flexibility in the inflatable member 74 so that it can withstand pressure pushes upward while it is inflated without substantial adverse impact on its function.

The inflatable member 74 can be made of a material compatible with the wellbore environment including the temperature and fluids expected to be present. At present, the preferred material for some applications, based on the criteria given above, is neoprene. Alternatively, nitrile rubber can be used.

Applicant has developed an apparatus A and method which allows for more effective gravel packing by providing various alternative ways to ensure that the granular material is deposited from the bottom up, starting from the packer in the wellbore. The apparatus A and the method have thus overcome a problem in prior designs caused by bridging or otherwise incomplete deposition and packing of the granular material when it is deposited from the top down.

The foregoing disclosure and description of the invention are illustrative and explanatory thereof, and various changes in the size, shape and materials, as well as in the details of the illustrated construction, may be made without departing from the spirit of the invention.

I claim:

1. An apparatus for gravel packing between a bottom and a top of a perforated interval in a wellbore, comprising:

a screen;

a sleeve circumscribing said screen and movably mounted with respect to said screen, creating an annular flowpath therebetween;

a seal member mounted to said sleeve for sealing between said sleeve and the wellbore; and said sleeve movable between a first position, where substantially all the perforations in an interval except those nearest the bottom are not in fluid communication with said flowpath, and a second position, where due to said movement additional higher perforations come into fluid communication with said flowpath, whereupon fluids bearing granular material can deposit said granular material from the bottom toward the top of the interval.

2. The apparatus of claim 1, wherein:

said seal member comprises:

at least one cup-shaped seal.

3. The apparatus of claim 1, wherein said seal member further comprises an inflatable structure.

4. The apparatus of claim 3, further comprising:

a flow restriction in flow communication with an internal passage in said inflatable structure; and whereupon pressurized delivery of granular material through said annular flowpath, said passage is pressurized, causing said structure to inflate.

5. The apparatus of claim 1, wherein:

said seal member is integral with said sleeve in a single inflatable structure.

6. The apparatus of claim 5, wherein:

said inflatable structure has a plurality of aligned seals thereon.

7. The apparatus of claim 6, wherein:

said seals are cup-shaped.

8. The apparatus of claim 5, wherein:

said inflatable structure has a passage extending therethrough, whereupon pumping granular material through said passage, said inflatable structure expands to allow contact of said seal member with the wellbore.

9. The apparatus of claim 8, wherein said inflatable structure further comprises:

a flow restriction to create sufficient backpressure in said passage to inflate said inflatable structure when granular material is pumped through said passage.

10. The apparatus of claim 9, wherein:

said inflatable structure comprises a plurality of aligned seals; and said inflatable structure selectively connected to said screen for tandem movement during run-in and relative movement thereafter.

11. The apparatus of claim 8, wherein:

said passage extends into said seal member; and a filter mechanism in said passage extension into said seal member to prevent granular material flowing through said passage from depositing internally in said seal member.

12. A method of gravel-packing a perforated interval in a wellbore, comprising the steps of:

setting a screen at a desired depth;

providing a shiftable sleeve relatively movable with respect to the screen;

providing a seal mounted to said sleeve for contact with the wellbore;

positioning said sleeve with respect to said screen so that the lowermost perforations in the interval are exposed;

pumping granular material between said screen and said sleeve;

shifting said sleeve to expose additional higher perforations; and continuing deposition of granular material to cover higher perforations in the interval.

13. A method of gravel-packing a perforated interval in a wellbore, comprising the steps of:

setting a screen at a desired depth;

providing a shiftable sleeve relatively movable with respect to the screen;

providing a seal comprising an inflatable member mounted to said sleeve for contact with the wellbore;

positioning said sleeve with respect to said screen so that the lowermost perforations in the interval are exposed;

pumping granular material over said screen and beyond said sleeve;

shifting said sleeve to expose additional higher perforations; and continuing deposition of granular material to cover higher perforations in the interval.

14. The method of claim 13, further comprising the step of:

inflating said inflatable member using at least a portion of the fluid which transports the granular material during said pumping step.

15. The method of claim 13, further comprising the step of:

using wellbore pressure built up by deposition of granular material to translate said sleeve upwardly.

16. The method of claim 13, further comprising the steps of:

providing a flow passage through said inflatable member;

performing said pumping and further deposition steps by moving granular material and fluid through said flow passage; and inflating said inflatable member with the fluid carrying the granular material which passes therethrough.

17. The method of claim 13, further comprising the step of:

inflating said inflatable member using fluid which carries the granular material during said pumping step.

18. The method of claim 13, further comprising the steps of:

combining said seal and sleeve as a unitary inflatable member;

performing said pumping step by forcing fluid through an internal passage through said member; and extending said internal passage into said seal so as to make said seal inflatable.

19. The method of claim 18, further comprising the step of:

screening the internal passage into said seal to allow substantially only fluid to pass therethrough for inflation thereof.

20. The method of claim 19, further comprising the steps of:

providing a flow restriction at the outlet of said internal passage for development of backpressure to inflate said inflatable member during said pumping;

fixing said inflatable member to said screen for run-in; and releasing said inflatable member for shifting with respect to said screen upon reaching the desired location downhole.

* * * * *